US010014597B2

(12) United States Patent
Gentsch et al.

(10) Patent No.: US 10,014,597 B2
(45) Date of Patent: Jul. 3, 2018

(54) ELECTRICAL CONNECTION FOR MEDIUM AND HIGH VOLTAGE SWITCHGEARS

(71) Applicant: ABB Schweiz AG, Baden (CH)

(72) Inventors: Dietmar Gentsch, Ratingen (DE); Wenkai Shang, Ratingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/607,691

(22) Filed: May 30, 2017

(65) Prior Publication Data

US 2017/0271786 A1 Sep. 21, 2017

Related U.S. Application Data

(63) Continuation of application No. PCT/EP2015/002409, filed on Dec. 1, 2015.

(30) Foreign Application Priority Data

Dec. 2, 2014 (EP) ..... 14004062

(51) Int. Cl.

| | |
|---|---|
| ***H01R 4/56*** | (2006.01) |
| ***H01R 13/03*** | (2006.01) |
| ***H01R 13/207*** | (2006.01) |
| ***H01R 13/621*** | (2006.01) |

(52) U.S. Cl.

CPC ..... *H01R 4/56* (2013.01); *H01R 13/03* (2013.01); *H01R 13/207* (2013.01); *H01R 13/6215* (2013.01)

(58) Field of Classification Search

CPC .... H01H 1/5866; H01H 33/025; H01H 71/08; Y10T 403/556; Y10T 403/56; Y10T 403/645; F16B 5/0275; F16B 7/182; F16B 39/284; H01R 4/5025; H01R 4/5033; H01R 4/308

USPC ..... 403/296, 299, 337; 439/784, 805, 886

See application file for complete search history.

(56) References Cited

U.S. PATENT DOCUMENTS

| | | | | |
|---|---|---|---|---|
| 1,743,888 A | | 1/1930 | Hamister | |
| 2,039,167 A | * | 4/1936 | Hopkins | B23K 35/0261 219/145.1 |
| 2,485,280 A | * | 10/1949 | Grace | F16B 33/02 254/98 |
| 3,569,609 A | | 3/1971 | Fowler et al. | |

(Continued)

FOREIGN PATENT DOCUMENTS

| | | | |
|---|---|---|---|
| CN | 102610936 | A | 7/2012 |
| JP | H 08115784 | A | 5/1996 |

*Primary Examiner* — Gary Paumen

(74) *Attorney, Agent, or Firm* — Leydig, Voit & Mayer, Ltd.

(57) ABSTRACT

An electrical connection for medium and high voltage switchgears, with an electrical terminal of a switchgear, wherein an electrical contacting surface of the electrical terminal is electrically connected with a contacting surface of an external electrical connector part via a connecting system. In order to ensure a low resistance electrical connection, the connecting system can have a female screw thread in a stud hole of the electrical terminal as well as in a stud hole of the external connector part, and a stretch bolt with male screw threads at each opposite ends, screwed into the female screw thread of the electrical terminal with one end of the stretch bolt, and into the female screw thread of the external connector part at the other end of the stretch bolt.

8 Claims, 5 Drawing Sheets

(56) References Cited

U.S. PATENT DOCUMENTS

| | | | | | |
|---|---|---|---|---|---|
| 4,050,773 | A | | 9/1977 | Newell | |
| 4,917,555 | A | * | 4/1990 | Taubert | F16B 5/0275 411/168 |
| 5,407,290 | A | * | 4/1995 | Tahon | H05B 7/14 252/511 |
| 5,466,102 | A | * | 11/1995 | Erickson | B23B 29/046 408/239 A |
| 5,769,583 | A | * | 6/1998 | Girbinger | F16B 35/042 411/388 |
| 5,927,157 | A | * | 7/1999 | Gosling | B23P 19/067 29/452 |
| 5,985,308 | A | * | 11/1999 | Burrell | A01N 59/16 106/1.05 |
| 6,199,453 | B1 | * | 3/2001 | Steinbock | B23P 19/068 29/452 |
| 6,381,827 | B1 | * | 5/2002 | Steinbock | B23P 19/068 29/452 |
| 6,516,901 | B1 | * | 2/2003 | Falgout, Sr. | E21B 7/067 175/256 |
| 8,697,247 | B2 | * | 4/2014 | Kaspar | H01R 13/03 200/265 |
| 8,708,322 | B2 | * | 4/2014 | Young | B64G 1/641 269/160 |
| 9,458,721 | B2 | * | 10/2016 | Palmer | F01D 5/066 |
| 9,475,594 | B2 | * | 10/2016 | Barber | B64G 1/641 |
| 2002/0062973 | A1 | * | 5/2002 | Yamada | H01L 23/24 174/59 |
| 2008/0176461 | A1 | * | 7/2008 | Waltz | H01R 4/5083 439/784 |
| 2015/0132979 | A1 | * | 5/2015 | Siebens | H01R 13/207 439/148 |
| 2015/0300404 | A1 | * | 10/2015 | Frank | F16C 35/04 384/510 |

* cited by examiner

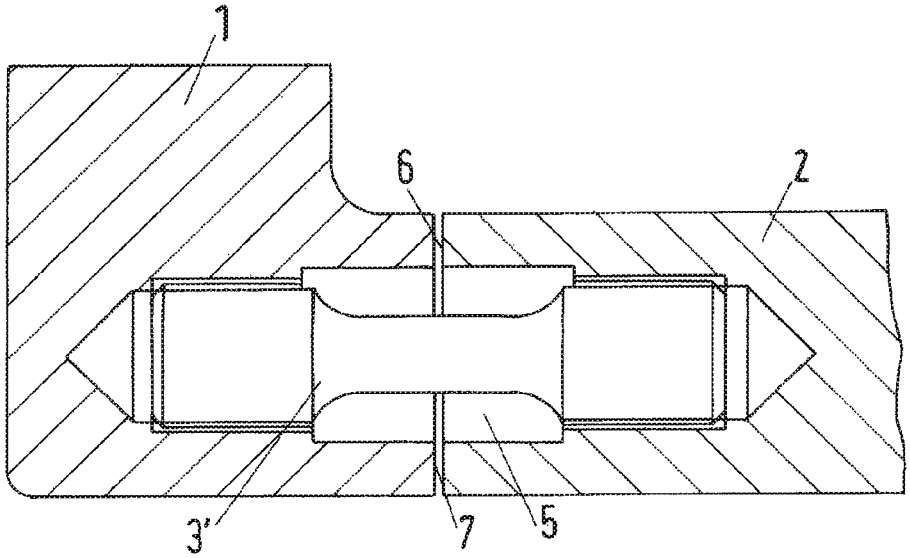
Fig.1
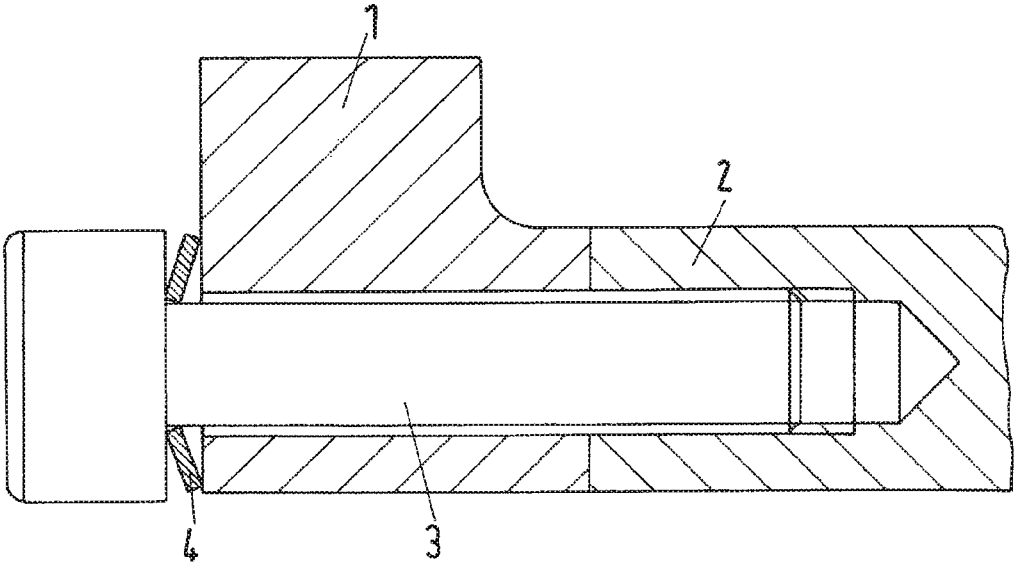
Fig.2 state of the art

ELECTRICAL CONNECTION FOR MEDIUM AND HIGH VOLTAGE SWITCHGEARS

CROSS-REFERENCE TO RELATED APPLICATIONS

This application is a bypass continuation of International Application No. PCT/EP2015/002409, filed on Dec. 1, 2015, and claims benefit to European Patent Application No. 14 004 062.7, filed on Dec. 2, 2014, the entire disclosure of each of which is hereby incorporated by reference herein. The International Application was published in English on Jun. 9, 2016, as WO 2016/087037 A1 under PCT Article 21(2).

FIELD

The invention relates to an electrical connection for medium and high voltage switchgears.

BACKGROUND

Electrical connections for medium and high voltage switchgears, with an electrical terminal of a switchgear, wherein an electrical contacting surface of the electrical terminal is electrically connected with a contacting surface of an external electrical connector via a connecting system, are well known. Bolts are used, which will be screwed into the connecting region from external edges of the connector.

A great disadvantage of such known electrical connections is, that externally accessible screws or bolts produce high electrical fields at sharp edges. Furthermore sharp edges are uncomfortable in the handling of the manufacture proceeding.

SUMMARY

An aspect of the invention provides a electrical connection for medium and high voltage switchgears, the connection comprising: an electrical terminal of a switchgear, an electrical contacting surface of the electrical terminal being electrically connected with a contacting surface of an external electrical connector part via a connecting system; a female screw thread in a stud hole of the electrical terminal, and in a stud hole of the external connector part; and a stretch and/or normal bolt including male screw threads at each opposite ends, screwed into the female screw thread of the electrical terminal with one end of the stretch and/or normal bolt, and into the female screw thread of the external connector part at the other end of the stretch and/or normal bolt.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 1 an embodiment of the invention wherein no bolt or screw head extends towards external edges of the connector;

FIG. 2 a embodiment of the state of the art;

DETAILED DESCRIPTION

Figure 3:
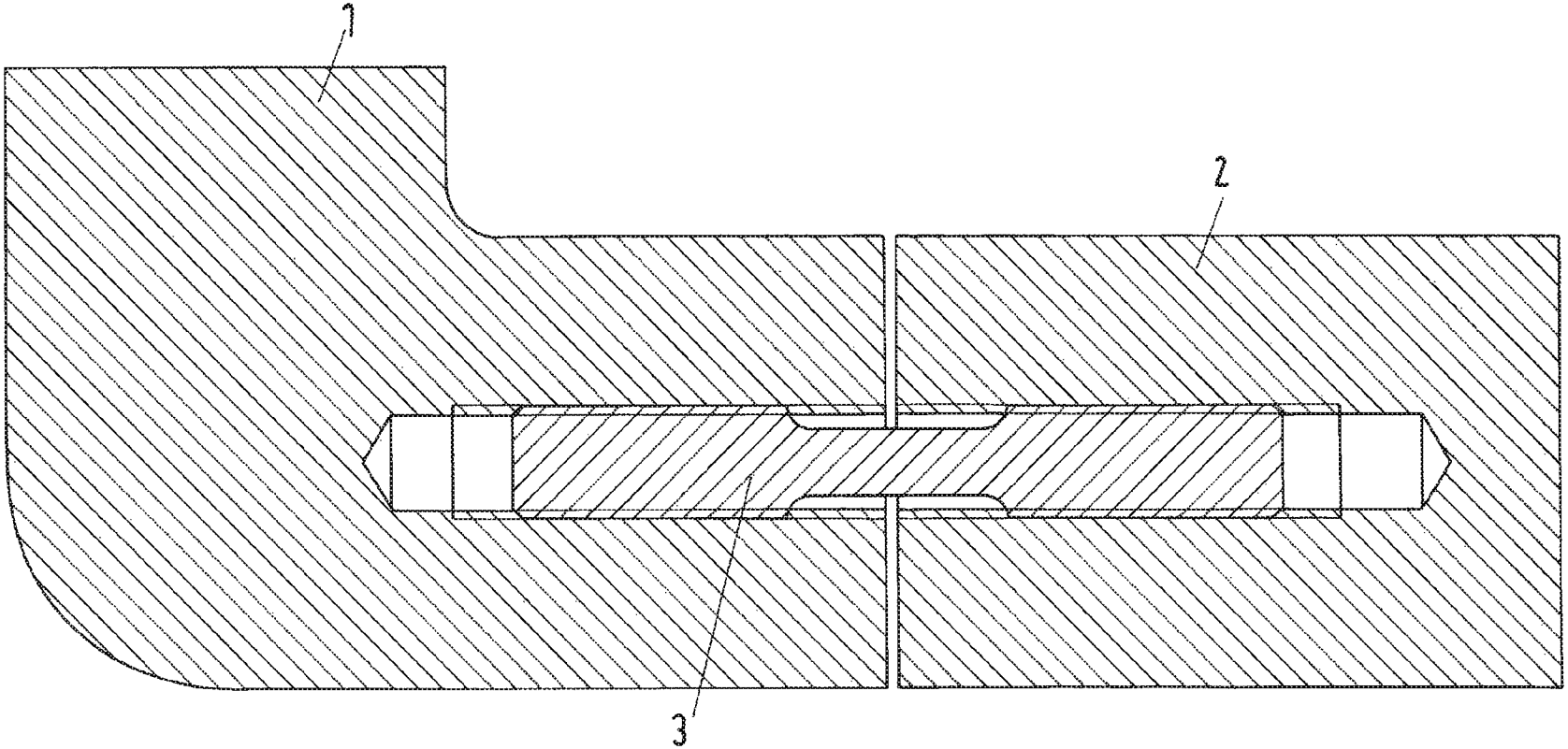
FIG. 3 an embodiment of the invention using of a stretch bolt without an extended cavity.

An aspect of the invention relates to an electrical connection for medium and high voltage switchgears, with an electrical terminal of a switchgear which is electrically connected with an external electrical connector.

An aspect of the invention to overcome these problems and to ensure an electrical low restistance connection.

An aspect of the invention provides a connecting system comprises a female screw thread in a stud hole of the electrical terminal as well as in a stud hole of the external connector part, and a stretch bolt with male screw threads at each opposite ends, screwed into the female screw thread of the electrical terminal with one end of the stretch bolt, and into the female screw thread of the external connector part at the other end of the stretch bolt.

So no external edges or external accessability of screws or bolts are any longer need. The use of the stretch bolt ensures a very close electrical and mechanical connection in order to reduce the transition contact resistance.

In an alternative, instead of a stretch bolt a normal bolt with male screw threads at each opposite ends is used. This bolt is then installed in the same way as the stretch bolt, according to the further features.

In a further embodiment the connecting system furthermore comprises, that the contacting surfaces of the terminal and of the electrical connector part are pretreated to have a flat surface, and that they are covered by gold or silver or other material with high conductivity. This feature furthermore enhances the electrical contact of the opposing surfaces.

In an alternative embodiment, but with same result as already mentioned in the aforesaid embodiment, the connecting system furthermore comprises, that the contacting surfaces of the terminal and of the electrical connector part are pretreated to be flat surfaces, and that a foil of gold or silver or copper is positioned between the contacting surfaces before the stretch bolt will be screwed in end locking position.

In a further advantageous embodiment, it is disclosed, that in the electrical terminal as well as in the external connector part, the female screw threads are arranged within further extended cavities, in such, that in the finally ready contacted state the cavities result in a common cavity around the stretching part of the installed stretch bolt.

Alternatively, in the electrical terminal or in the external connector part, the female screw threads are arranged within a further extended cavity, in such, that in the finally ready contacted state the cavity result in a cavity only in the electrical terminal or in the external connector part around the stretching part of the installed stretch bolt.

According to a method to assemble an electrical connection for medium and high voltage switchgears, the problem is solved by that the connecting system comprises a female screw thread in a stud hole of the electrical terminal as well as in a stud hole of the external connector part, and a stretch bolt with male screw threads at each opposite ends, screwed into the female screw thread of the electrical terminal with one end of the stretch bolt, and into the female screw thread of the external connector part at the other end of the stretch bolt, in such, that in a first step, the stretch bolt will be screwed with the male screw thread at its one end into the female screw thread of the stud hole of the electrical terminal, and in a further step the external connector part will be screwed on the male screw thread at the other end of the stretch bolt end by rotating the external connector part around the long axis of the stretch bolt, until the contacting surfaces come into contact, and in a further step the external connector part will be screwed further until it reaches a predefined torque momentum value, by which the stretch bolt will be extended inside its elastic Hook range. Already important advantageous embodiments are supported by the assembling method.

First advantageous alternative to that is, that the contacting surfaces of the external connector part and the electric terminal are pretreated to be flat and smooth, and in parallel to each other in the installed end position, and that at least one of them is covered with a gold and/or silver and/or copper layer.

Second advantageous alternative to that is, that before the external connector part will be screwed on the stretch bolt, a foil made of gold and/or silver and/or copper is positioned between the contacting surfaces before the external connector will be screwed into the end position on the stretch bolt.

An electrical connection as known in the state of the art is shown in FIG. 2. The bolt 3 for the fixation of the electrical terminal 2 with the connector part 1 is screwed via a clearance hole in the connector part 1 into a female screw thread of the electrical terminal. Then the bolt 3 will be screwed until a spring washer 4 comes close until the end screw position.

The visible disadvantage is, that the fixing bolt extends far over the edge of the connector part. This results in high electrical field at that position. Furthermore it disturbs in the manual handling during positioning that part into a switchgear housing.

An embodiment of the invention is shown in FIG. 1. The difference over the state of the art is, that no bolt or screw head extends towards external edges of the connector 1.

The fixation bolt 3' is embellished as a stretch bolt, which consist at least in its middle part of its length of elastic stretchable material. So the stretch bolt will first be screwed into the female thread of the terminal 2. Then the opposite end of the of the stretch bolt will be screwed with its male thread into a female thread hole of the connector part 1. Then the connector part will be rotated as such, that the connector 1 comes close to the terminal 2. Then when both opposing surfaces 6 and 7 comes into contact, the terminal 1 will be rotated further during measuring the momentum of force. By that the stretch bolt 3' will be deformed in its middle zone, until the momentum of force reaches a predetermined value, in order of keep within the Hook's value of elasticity.

Then a close contact is given, without any externally visible bolt or screw.

In order to enhance furthermore the contact, as well as to enable a reproducible connecting force in the serial manufacture of switchgears for example, the opposing surfaces 6 and 7 of the terminal 2 and the connector part 1 are pretreated to be flat as best as possible and perfectly parallel, by each possible mechanical pretreatment, in order to reduce additional friction as well as to produce a close electrical connection, to reduce transition resistances.

This can be furthermore enhanced by covering the aforesaid surfaces 6 and 7 with a gold, silver or further copper layer.

Possible is also to use a flat foil between the surfaces before fixation.

Further embodiments are shown in the FIGS. 3 to 6.

Figure 4:
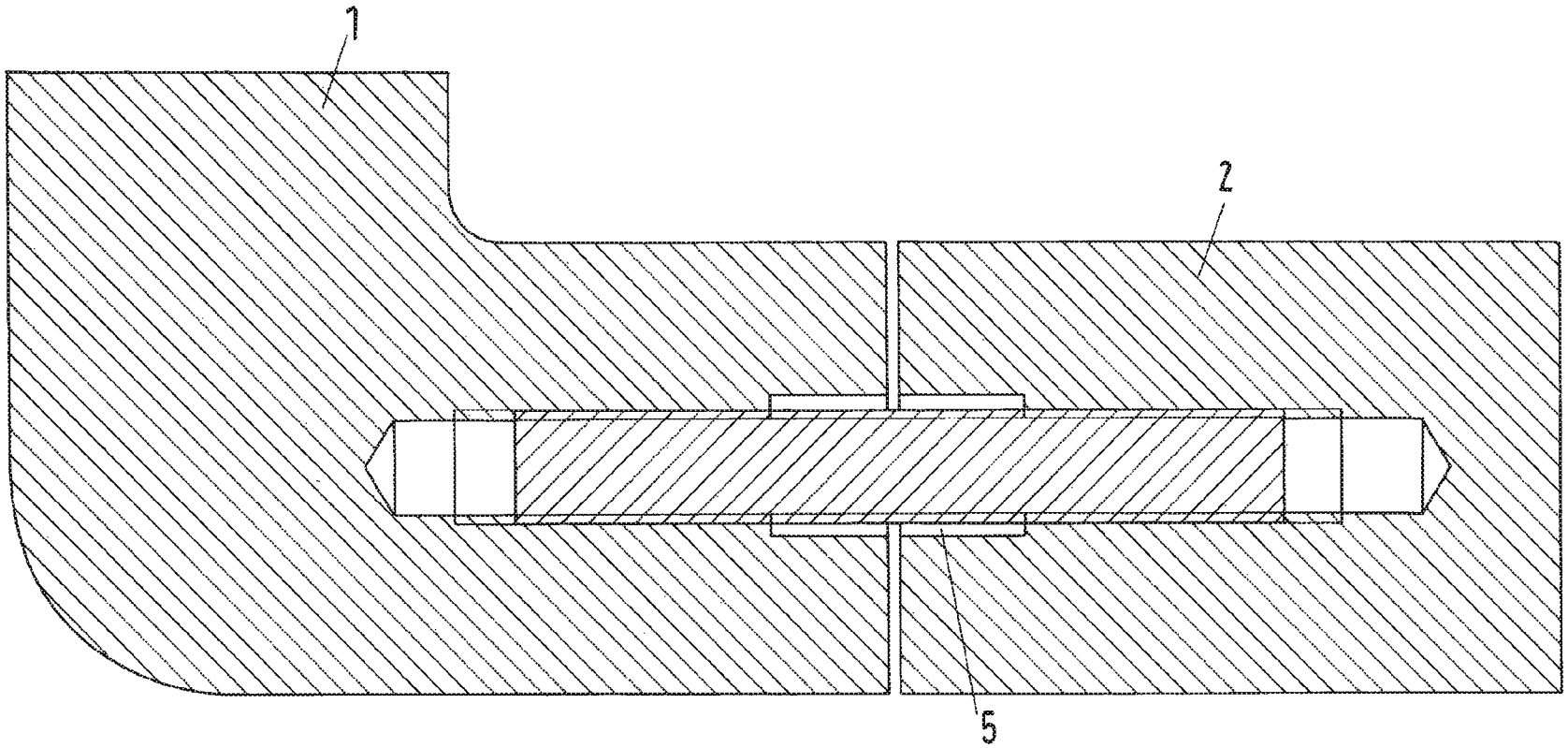
FIG. 4 a first embodiment of the invention using a normal bolt instead of stretch bolt.
Figure 6:
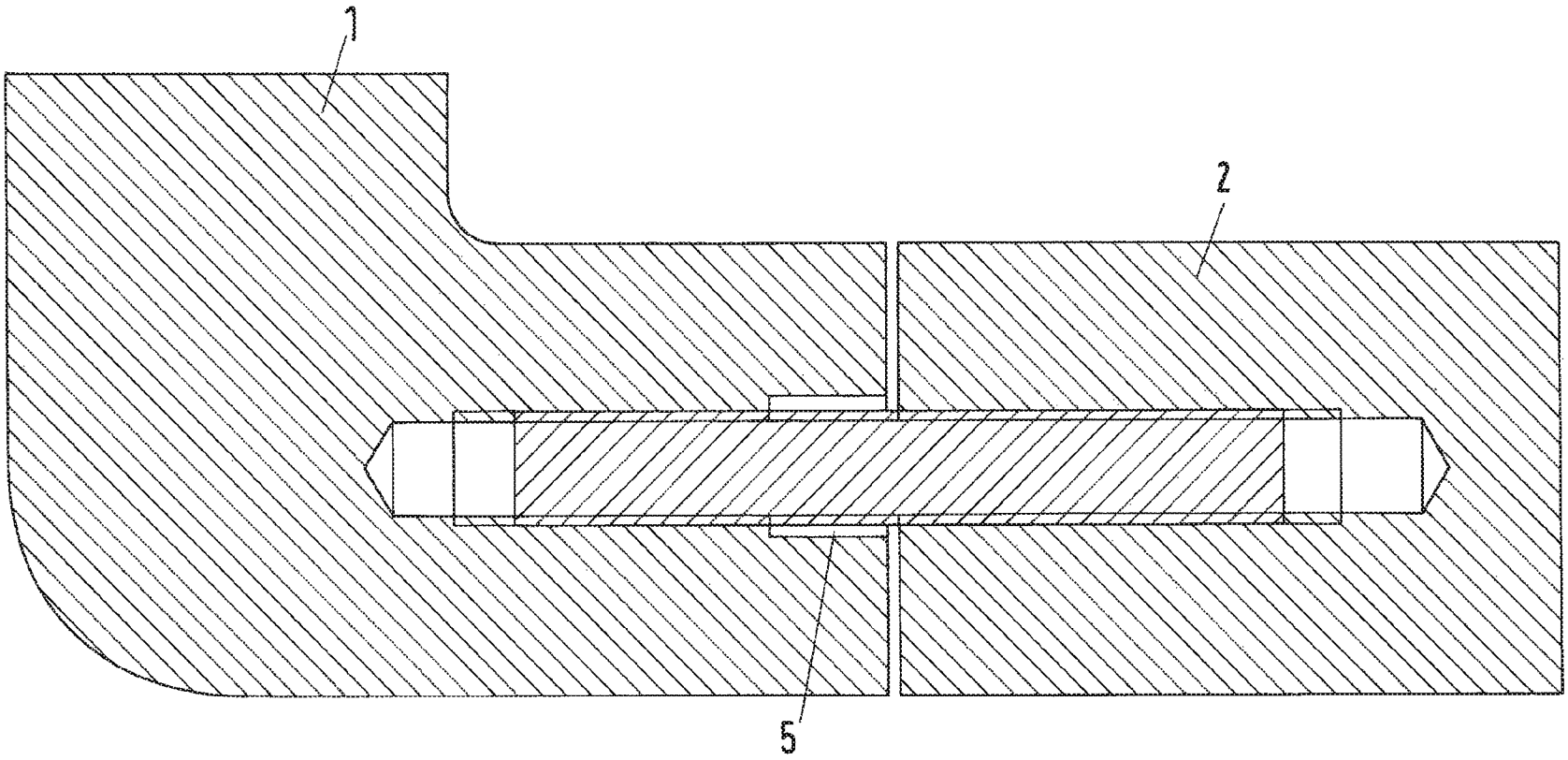
FIG. 6 a third embodiment of the invention using a normal bolt instead of a stretch bolt.

FIGS. 4 and 6 are showing the use of normal bolts, not stretch bolts. So the invention is applicable also for that.

FIG. 4 is further showing, that a cavity 5 is placed in both parts, that means in the external connector part 1, as well as in electrical terminal 2, so that the fixed system results in a common cavity. In FIG. 6, only a cavity 5 in the electrical terminal 2 is placed.

FIG. 3 shows the use of a stretch bolt, but without any extended cavity. A cavity will be caused by reduced diameter in the stretching part of the stretch bolt.

Figure 5:
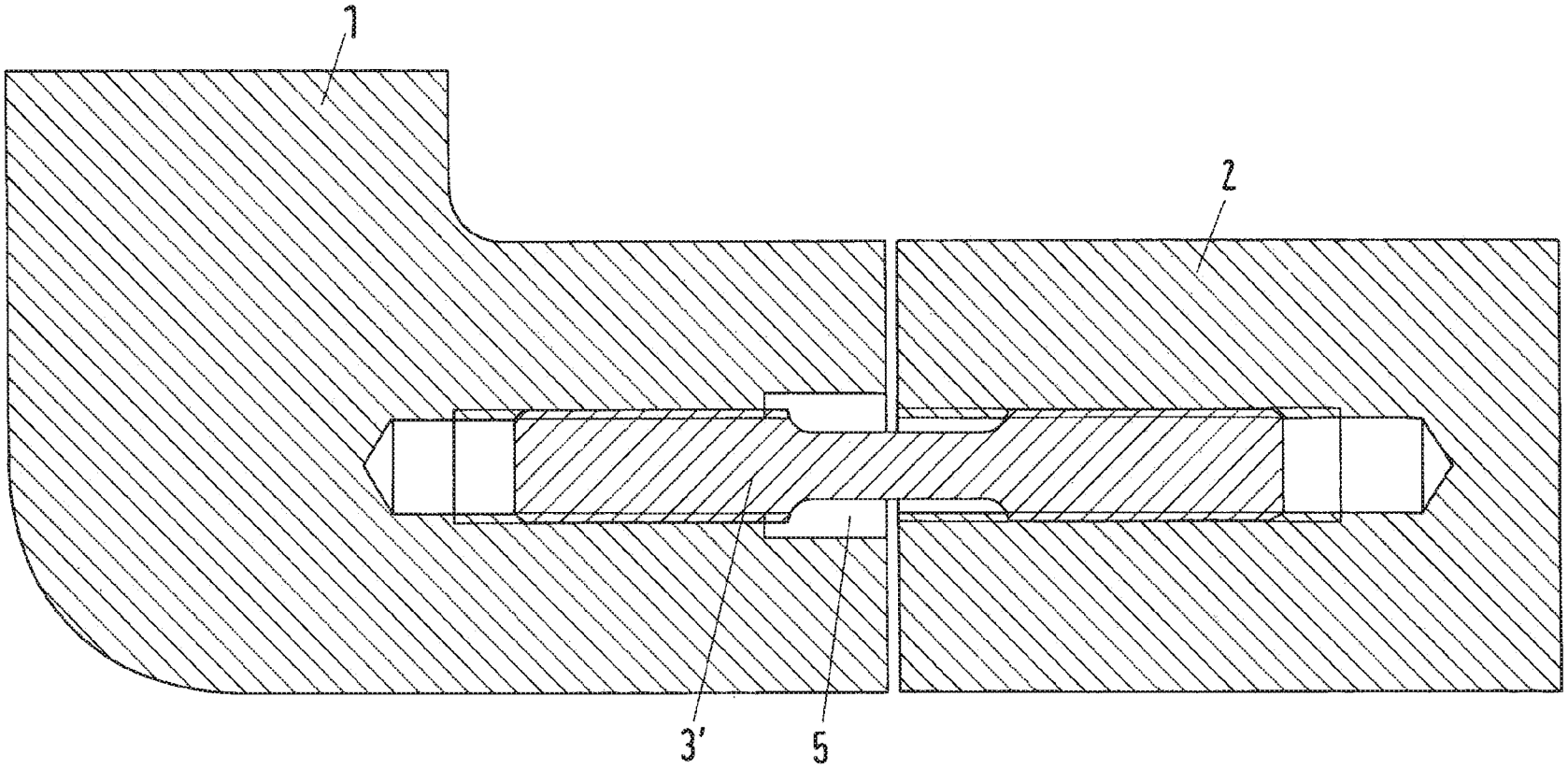
FIG. 5 a second embodiment of the invention using a normal bolt.

FIG. 5 shows an alternative, in which a stretch bolt is used with only an extended cavity 5 located in the external connector part.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An electrical connection for medium and high voltage switchgears, the connection comprising:

an electrical terminal of a switchgear, an electrical contacting surface of the electrical terminal being electrically connected with a contacting surface of an external electrical connector part via a connecting system;

a female screw thread in a stud hole of the electrical terminal, and in a stud hole of the external connector part; and a stretch bolt including male screw threads at each opposite end, screwed into the female screw thread of the electrical terminal with one end of the stretch bolt, and into the female screw thread of the external connector part at the other end of the stretch bolt, wherein the male screw threads are screwed together with the female screw threads such that the stretch bolt is deformed in its middle zone within a Hook's value of elasticity of a material of the stretch bolt.

2. The connection of claim 1, wherein contacting surfaces of the electric terminal and of the electrical connector part are pretreated to have a flat surface, and wherein the contacting surfaces include a coating including gold, silver, and/or another material with high conductivity.

3. The connection of claim 1, wherein contacting surfaces of the terminal and of the electrical connector part are pretreated to be flat surfaces, and include a foil of gold or silver or copper, positioned between the contacting surfaces before the stretch bolt is screwed in end locking position.

4. The connection of claim 1, wherein, in the electrical terminal and in the external connector part, the female screw threads are arranged within further extended cavities, such that, in an operational contacted state, the cavities result in a common cavity around a stretching part of an installed stretch bolt.

5. The connection of claim 1, wherein, in the electrical terminal or in the external connector part, the female screw threads are arranged within a further extended cavity such that, in an operational contacted state, there is a cavity only in the electrical terminal or in the external connector part around a stretching part of the installed stretch bolt.

6. A method of assembling the connection of claim 1, the method comprising:

screwing the stretch bolt with a male screw thread at its one end into the female screw thread of the stud hole of the electrical terminal;

screwing the external connector part on the male screw thread at the other end of the stretch bolt end by rotating the external connector part around a long axis of the stretch bolt, until contacting surfaces come into contact; and screwing the external connector part further until it reaches a predefined torque, by which the stretch bolt extends within the Hook's value of elasticity of the material of the stretch bolt.

7. The method of claim 6, further comprising:

pretreating the contacting surfaces of the external connector part and the electric terminal to be flat and smooth, and in parallel to each other in the installed end position; and covering at least one of the contacting surfaces with a gold, silver, and/or copper layer.

8. The method of claim 7, further comprising, before screwing the external connector part on the stretch bolt:

positioning a foil including gold, silver, and/or copper between the contacting surfaces before the external connector is screwed into an end position on the stretch bolt.

* * * * *